US005586343A

United States Patent [19]

Mayle

[11] Patent Number: 5,586,343

[45] Date of Patent: Dec. 24, 1996

[54] WHEEL CHAIR WITH A REMOVABLE TOILET BOWL AND SEAT

[76] Inventor: Dawn M. Mayle, 827 W. River Rd. N., Elyria, Ohio 44035

[21] Appl. No.: 517,731

[22] Filed: Aug. 21, 1995

[51] Int. Cl.[6] ..... A47K 11/06; A61G 7/02

[52] U.S. Cl. ..... 4/480; 280/304.1

[58] Field of Search ..... 4/464–483; 280/250.1, 280/304.1

[56] References Cited

U.S. PATENT DOCUMENTS

| | | | |
|---|---|---|---|
| 341,135 | 5/1886 | Ellison | 4/478 |
| 601,312 | 3/1898 | Beall | 4/483 |
| 909,758 | 1/1909 | Collings | 4/483 X |
| 1,229,657 | 6/1917 | Ross | 4/478 |
| 4,550,455 | 11/1985 | Carson et al. | 4/480 |
| 4,713,848 | 12/1987 | Domors et al. | 4/480 |

FOREIGN PATENT DOCUMENTS

| | | | |
|---|---|---|---|
| 0240205 | 10/1911 | Germany | 4/480 |

*Primary Examiner*—Charles E. Phillips

[57] ABSTRACT

A wheel chair with a removable toilet bowl and seat, comprising a frame which has two forward vertical rails and two rearward vertical rails with horizontal rails coupled therebetween to form a wheel chair with a push handle at the upper extent of the rearward vertical rails and wheels rotatably secured to the lower extent of the frame. A pair of upper slide rails in a horizontal orientation and spaced parallel with respect to each other are coupled at their forward ends to the forward vertical rail and coupled at their rearward ends to the rearward vertical rail. A pair of lower slide rails in a horizontal orientation and spaced parallel with respect to each other are coupled at their forward ends to the forward vertical rail and coupled at their rearward ends to the rearward vertical rail. A pair of upper channels are formed in the upper slide rails facing each other and are laterally spaced by a first predetermined distance. A pair of lower channels are formed in the lower slide rails facing each other and are laterally spaced by a first predetermined distance. An upper tray is formed in a planar configuration with enlarged horizontal lateral edges received in the upper channels and formed with a central planar surface to constitute a seat for a user. A lower tray with enlarged horizontal lateral edges is received in the lower channels. The central extent of the lower tray is formed with a recess to function as a toilet.

5 Claims, 3 Drawing Sheets

20
10
12
18
16
26
12
18
22

20
16
26
40
3
26
28
48
28
16
18
22

56
60
26
16
40
44
26
32
42
36
46
28
16

WHEEL CHAIR WITH A REMOVABLE TOILET BOWL AND SEAT

BACKGROUND OF THE INVENTION

1. Field of the Invention

The present invention relates to a wheel chair with a removable toilet bowl and seat and more particularly pertains to allowing people in wheel chairs to more easily and comfortably undergo bodily waste elimination.

2. Description of the Prior Art

The use of wheel chairs and toilets of various designs and configurations is known in the prior art. More specifically, wheel chairs and toilets of various configurations heretofore devised and utilized for the purpose of facilitating the transportation of invalids in wheel chairs and to facilitate individuals in wheel chairs to undergo bodily waste elimination are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,127,113 to Di Matteo et al. an invalid transfer arrangement.

U.S. Pat. No. 5,282,284 to Brantman et al. discloses a sliding transfer device.

U.S. Pat. No. 5,207,549 to Riva discloses a transfer seat to be used between a wheelchair and an automobile seat.

Lastly, U.S. Pat. No. 5,201,377 to Wilson discloses a wheelchair with sidewardly swingable seat.

In this respect, the wheel chair with a removable toilet bowl and seat according to the present invention substantially departs from the conventional concepts and designs of the prior art, and in so doing provides an apparatus primarily developed for the purpose of allowing people in wheel chairs to more easily and comfortably undergo bodily waste elimination.

Therefore, it can be appreciated that there exists a continuing need for new and improved wheel chair with a removable toilet bowl and seat which can be used for allowing people in wheel chairs to more easily and comfortably undergo bodily waste elimination. In this regard, the present invention substantially fulfills this need.

SUMMARY OF THE INVENTION

In view of the foregoing disadvantages inherent in the known types of use of wheel chairs and toilets of various designs and configurations now present in the prior art, the present invention provides an improved wheel chair with a removable toilet bowl and seat. As such, the general purpose of the present invention, which will be described subsequently in greater detail, is to provide a new and improved wheel chair with a removable toilet bowl and seat apparatus and method which has all the advantages of the prior art and none of the disadvantages.

To attain this, the present invention essentially comprises a new and improved wheel chair with a removable toilet bowl and seat, comprising, in combination, a frame having two forward vertical rails and two rearward vertical rails with horizontal rails coupled therebetween to form a wheel chair with a push handle at the upper extent of the rearward vertical rails and wheels rotatably secured to the lower extent of the frame. A pair of upper slide rails are provided in a horizontal orientation and spaced parallel with respect to each other and coupled at their forward ends to the forward vertical rail and coupled at their rearward ends to the rearward vertical rail. A pair of lower slide rails are also provided and are in a horizontal orientation and spaced parallel with respect to each other and coupled at their forward ends to the forward vertical rail and coupled at their rearward ends to the rearward vertical rail. A pair of upper C-shaped channels are formed in the upper slide rails facing each other and laterally spaced by a first predetermined distance. A pair of lower C-shaped channels are formed in the lower slide rails facing each other and laterally spaced by a first predetermined distance. An upper tray is formed in a planar configuration with enlarged horizontal lateral edges received in the upper channels and formed with a central planar surface to constitute a seat for a user. A lower tray with enlarged horizontal lateral edges is received in the lower channels. The central extent of the lower tray is formed with a recess to function as a toilet. Two pair of recesses are formed on the exterior surface of each tray facing outwardly at a forward extent thereof and at a rearward extent thereof. Two pair of holes are formed in the exterior surface of each slide rail at a forward extent thereof and at a rearward extent thereof. A pair of pivotable catches are secured to the forward and rearward vertical rails adjacent to the slide rails adapted to move to an inoperative position remote from the trays to allow for the sliding movement of the trays with respect to the slide rails and an operative position within the recesses in interference contact with the trays to preclude inadvertent removal of the trays from the slide rails.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wheel chair with a removable toilet bowl and seat which has all the advantages of the prior art and none of the disadvantages.

It is another object of the present invention to provide a new and improved wheel chair with a removable toilet bowl and seat which may be easily and efficiently manufactured and marketed.

It is a further object of the present invention to provide a new and improved wheel chair with a removable toilet bowl and seat which is of a durable and reliable construction.

An even further object of the present invention is to provide a new and improved wheel chair with a removable toilet bowl and seat which is susceptible of a low cost of manufacture with regard to both materials and labor, and which accordingly is then susceptible of low prices of sale to the consuming public, thereby making such use of wheel chairs and toilets of various designs and configurations economically available to the buying public.

Still yet another object of the present invention is to provide a new and improved wheel chair with a removable toilet bowl and seat which provides in the apparatuses and methods of the prior art some of the advantages thereof, while simultaneously overcoming some of the disadvantages normally associated therewith.

Still another object of the present invention is to allow people in wheel chairs to more easily and comfortably undergo bodily waste elimination.

Lastly, it is an object of the present invention to provide a new and improved wheel chair with a removable toilet bowl and seat comprising a frame which has two forward vertical rails and two rearward vertical rails with horizontal rails coupled therebetween to form a wheel chair with a push handle at the upper extent of the rearward vertical rails and wheels rotatably secured to the lower extent of the frame. A pair of upper slide rails in a horizontal orientation and spaced parallel with respect to each other are coupled at their forward ends to the forward vertical rail and coupled at their rearward ends to the rearward vertical rail. A pair of lower slide rails in a horizontal orientation and spaced parallel with respect to each other are coupled at their forward ends to the forward vertical rail and coupled at their rearward ends to the rearward vertical rail. A pair of upper channels are formed in the upper slide rails facing each other and laterally spaced by a first predetermined distance. A pair of lower channels are formed in the lower slide rails facing each other and laterally spaced by a first predetermined distance. An upper tray is formed in a planar configuration with enlarged horizontal lateral edges received in the upper channels and formed with a central planar surface to constitute a seat for a user. A lower tray with enlarged horizontal lateral edges is received in the lower channels. The central extent of the lower tray is formed with a recess to function as a toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
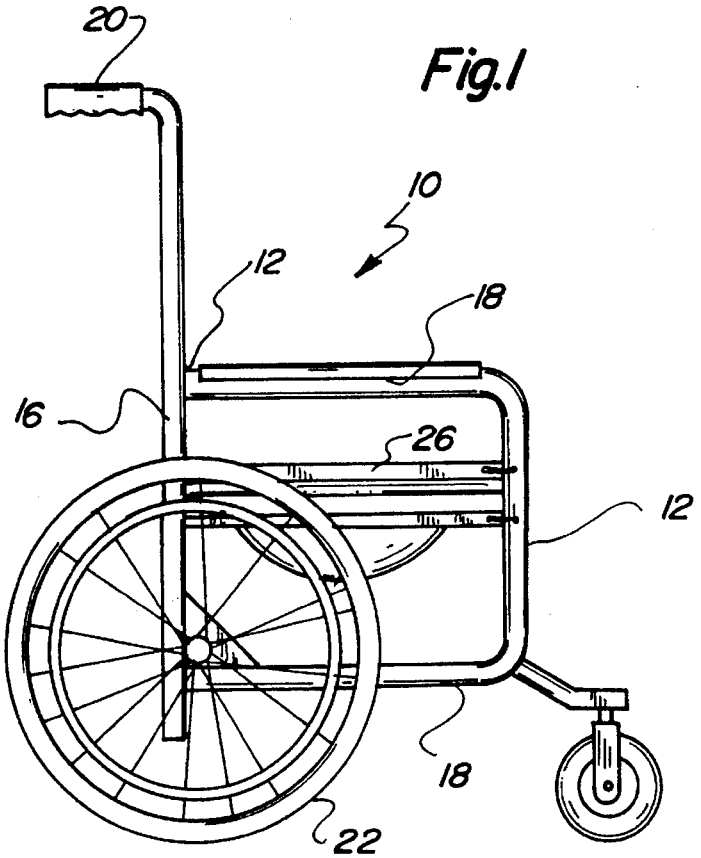
FIG. 1 is a side elevational view of the preferred embodiment of the wheel chair with a removable toilet bowl and seat constructed in accordance with the principles of the present invention.
Figure 2:
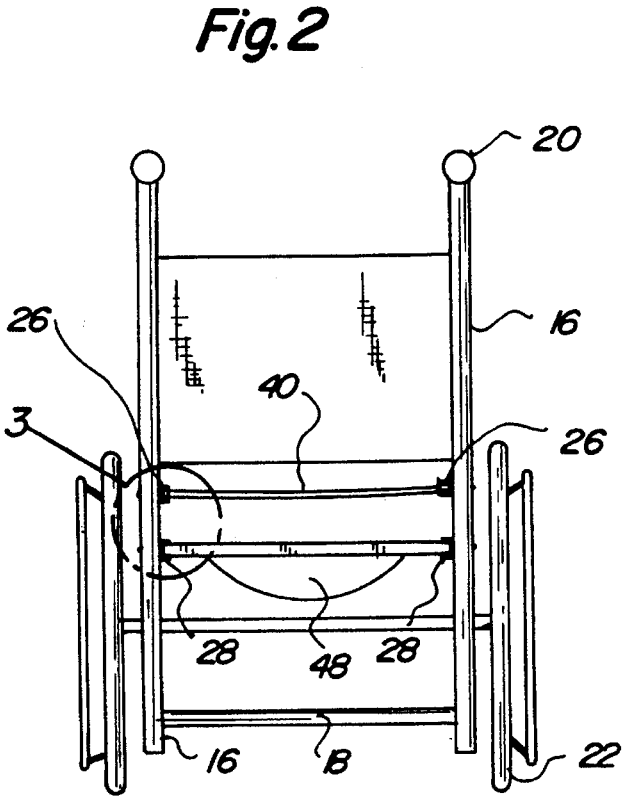
FIG. 2 is rear elevational view of the device shown in FIG. 1.
Figures 3, 4:
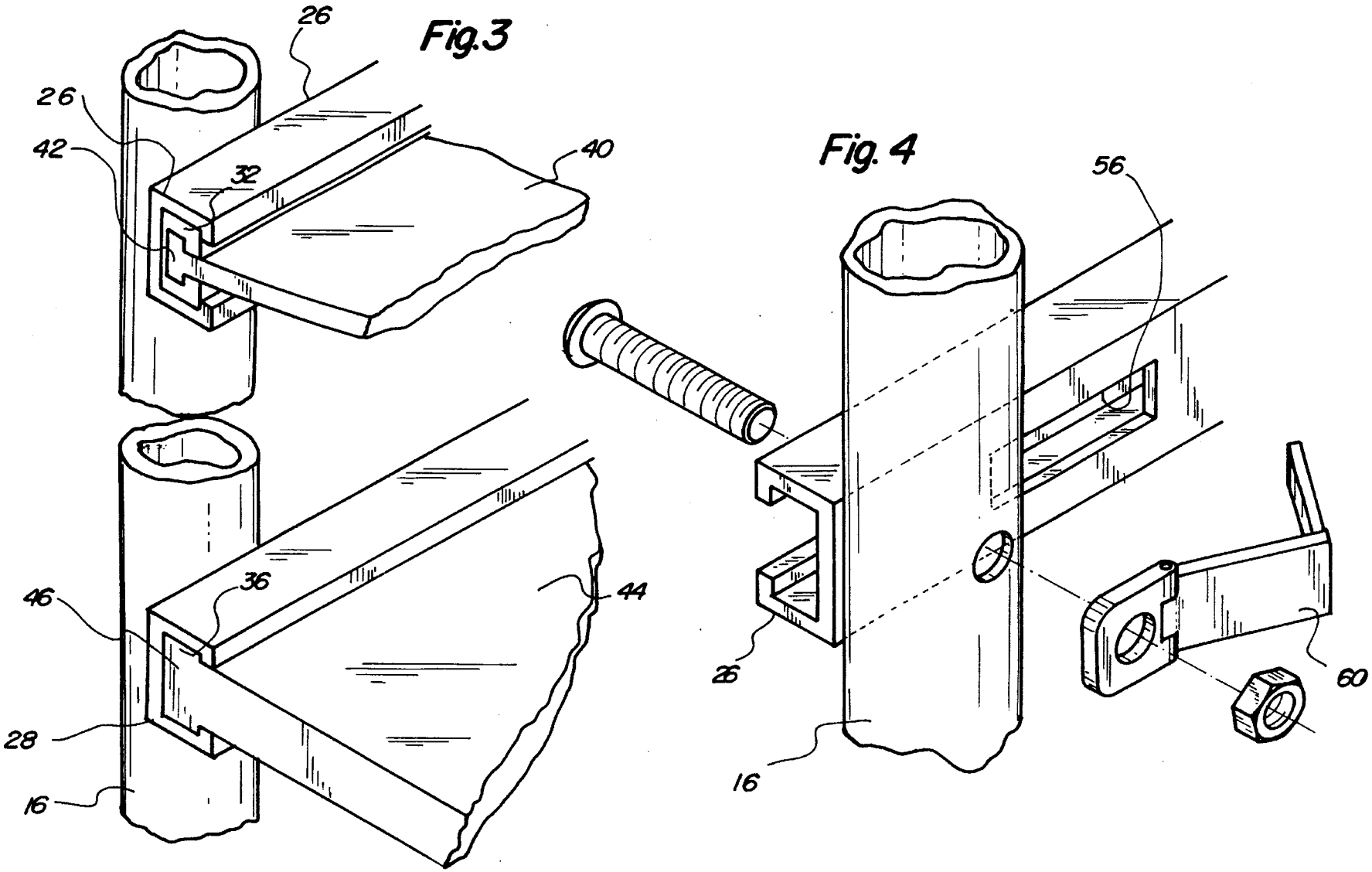
FIG. 3 is an enlarged perspective view taken at circle 3 of FIG. 2.
FIG. 4 is an enlarged exploded view of the coupling of one slide to one rail.
Figure 5:
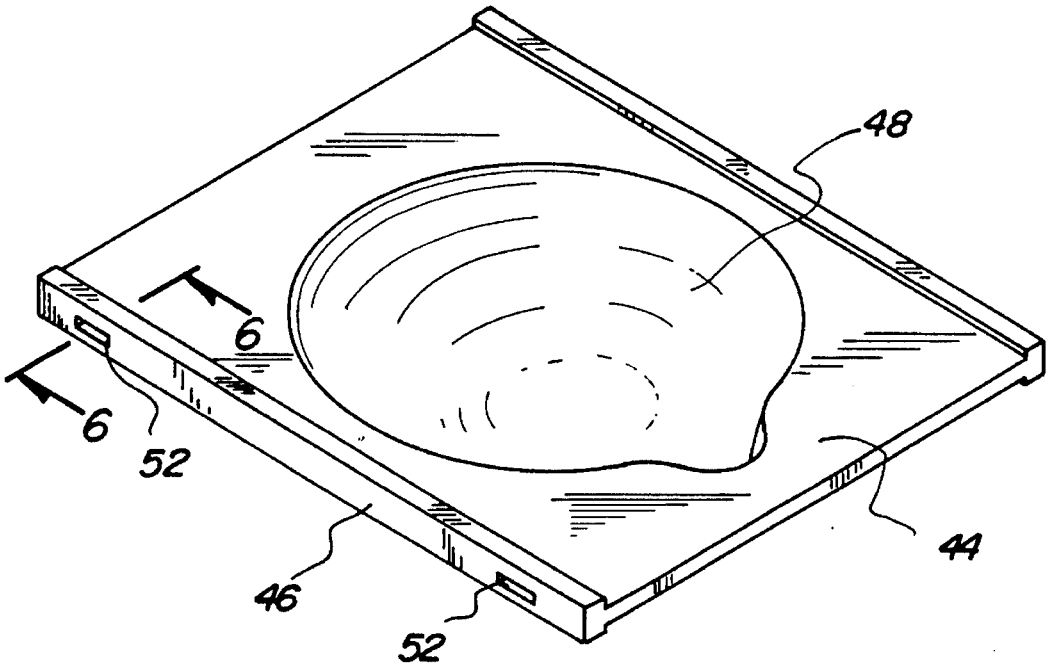
FIG. 5 is an perspective view of the lower tray as shown in FIGS. 1, 2 and 3.
Figure 6:
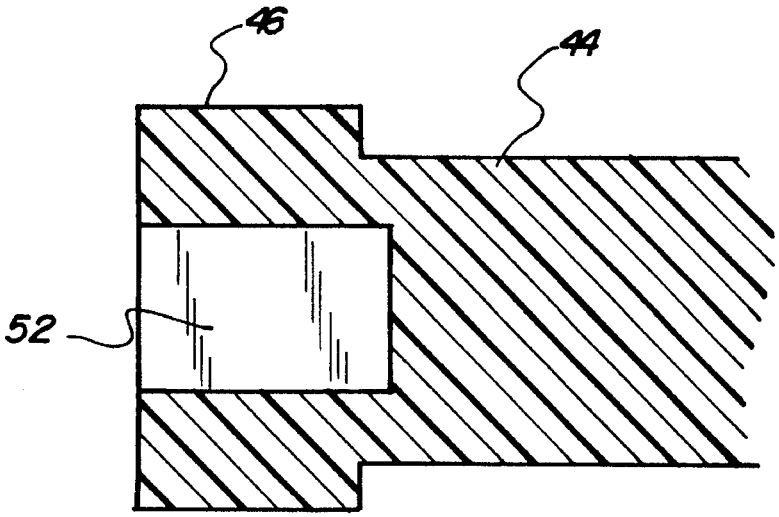
FIG. 6 is a cross-sectional view taken along line 6—6 of FIG. 5.

With reference now to the drawings, and in particular to FIG. 1 thereof, a new and improved wheel chair with a removable toilet bowl and seat embodying the principles and concepts of the present invention and generally designated by the reference numeral 10 will be described.

The present invention, the new and improved wheel chair with a removable toilet bowl and seat, is comprised of a plurality of components. Such components in their broadest context include a frame, upper and lower slide rails, upper and lower C-shaped channels, an upper tray, a lower tray, recesses, holes and catches. Such components are individually configured and correlated with respect to each other so as to attain the desired objective.

More specifically, the central component of the wheelchair 10 of the present invention is a frame 12. The frame has two forward vertical rails 14. It also has two rearward vertical rails 16. Horizontal rails 18 couple the forward and rearward rails. Together the rails form the central component or frame of the wheelchair. In addition, the frame includes a push handle 20 at the upper extent of the rearward vertical rails. The frame also includes wheels 22 rotatably secured to the lower extent of the frame. The forward wheels are preferably rotatable about a vertical axis to constitute casters for improved maneuverability.

Coupled with respect to the frame are a pair of upper slide rails 26. Such upper slide rails are in a horizontal orientation. They are spaced parallel with respect to each other. They are coupled at their forward ends to the forward vertical rails. They are coupled at their rearward ends to the rearward vertical rails.

In addition to the upper slide rails 26, there are provided a pair of lower slide rails 28. The lower slide rails are in a horizontal orientation. They are spaced parallel with respect to each other. They are coupled at their forward ends to the forward vertical rails. They are coupled at their rearward ends to the rearward vertical rails.

Next provided, in association with the upper slide rails are a pair of upper C-shaped channels 32. Such channels are formed in the upper slide rails in an orientation to face each other. They are laterally spaced by a first predetermined distance.

In association with the upper C-shaped channels 32 are a pair of lower C-shaped channels 36. Such channels are formed in the upper slide rails in an orientation to face each other. They are laterally spaced by a first predetermined distance.

In association with the upper slide rails 26 and upper C-shaped channels 32 is an upper tray 40. Such upper tray is formed in a planar configuration. It is formed with an enlarged horizontal lateral edges 42. Such lateral edges are received in the upper channels of the upper slide rails. The upper tray has a lateral dimension essentially equal to the first predetermined distance. The upper tray constitutes a seat for the user.

A lower tray 44 is next provided. The lower tray is formed with enlarged horizontal lateral edges 46. Such lateral edges are positionable in the lower channels of the lower slide rails. The lateral dimension of the lower tray is also equal to the first predetermined distance. The central extent of the lower tray is formed with a generally hemispherical shaped recess 48 extending downwardly therefrom. Such recess functions as a toilet during operation and use when the upper tray is removed.

Further capabilities are provided to the system by a locking/unlocking assembly. Such locking/unlocking assembly includes two pair of recesses 52. Two pair of such recesses are formed in each tray. They face outwardly at a forward extent of the tray and at a rearward extent of the tray.

Positioned in association with the two pair of recesses are two pair of holes 56. Such holes are formed in the exterior surface of each slide rail. They are located at the forward extents of the slide rails and at the rearward extents thereof. They are adapted to overlie the recesses when positioned during normal operation and use.

Lastly provided are a pair of pivotable catches 60. Such catches are secured to the vertical rails through a nut and bolt assembly. They include a pivot pin and a finger. The catches are secured to the forward and rearward vertical rails. They are located adjacent to the slide rails and are adapted to move between inoperative and operative positions. In the inoperative position, the catches are rotated remote from the trays. This is to allow for the sliding movement of the trays with respect to the slide rails. When in the operative position, the catches are pivoted through the holes into the recesses in interfering contact with the tray. Such an orientation precludes inadvertent removal of the trays from the slide rails.

The present invention is a removable toilet bowl and seat for use with wheelchairs. This receptacle enables the patient to stay in the chair rather than having to be lifted out or transported.

This specialized seat is made from smooth, hard plastic, similar to that which is used in conventional bathrooms. Four preformed metal or steel brackets are provided for mounting to existing wheelchairs, or as part of the original manufacturing process for new apparatuses. The existing seat will be modified in the same way to enable it to slide out as well. High quality hardware, including a safety latch, holds these seats securely in place.

A patient, with the help of an aide or nurse, must lift up slightly to allow the regular seat to be removed. Directly below this, already in place, is the receptacle. Gently, the user is set back down on this "toilet" and the necessary garments are moved out of the way. Now the individual is left alone to go to the bathroom. When finished, the assistant helps the patient to clean up and then lift up to remove the basin and insert the original seat. The waste is disposed of properly and the seat sanitized. It can now be slid back in place for use at a later time.

The slide out seat will allow individuals who use wheelchairs to more easily and comfortably undergo waste elimination. It is a simple design that lends itself to ease of manufacturing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A wheel chair with a removable toilet bowl and seat, comprising:

a frame having two forward vertical rails and two rearward vertical rails with horizontal rails coupled therebetween to form a wheel chair with a push handle at the upper extent of the rearward vertical rails and wheels rotatably secured to the lower extent of the frame;

a pair of upper slide rails in a horizontal orientation and spaced parallel with respect to each other and coupled at their forward ends to the forward vertical rail and coupled at their rearward ends to the rearward vertical rail;

a pair of lower slide rails in a horizontal orientation and spaced parallel with respect to each other and coupled at their forward ends to the forward vertical rail and coupled at their rearward ends to the rearward vertical rail;

a pair of upper channels formed in the upper slide rails facing each other and laterally spaced by a first predetermined distance;

a pair of lower channels formed in the lower slide rails facing each other and laterally spaced by a first predetermined distance;

an upper tray formed in a planar configuration with enlarged horizontal lateral edges received in the upper channels and formed with a central planar surface to constitute a seat for a user; and a lower tray with enlarged horizontal lateral edges received in the lower channels, the central extent of the lower tray being formed with a recess to function as a toilet.

2. The apparatus as set forth in claim 1 and further including a pair of catches secured to the forward and rearward vertical rails adjacent to the slide rails adapted to move to an inoperative position remote from the trays to allow for the sliding movement of the trays with respect to the slide rails and an operative position within the recesses in interference contact with the trays to preclude inadvertent removal of the trays from the slide rails.

3. The apparatus as set forth in claim 1 and further including two pair of recesses formed on the exterior surface of each tray facing outwardly at a forward extent thereof and at a rearward extent thereof.

4. The apparatus as set forth in claim 1 and further including two pair of holes formed in the exterior surface of each slide rail at a forward extent thereof and at a rearward extent thereof.

5. A new and improved wheel chair with a removable toilet bowl and seat, comprising, in combination:

a frame having two forward vertical rails and two rearward vertical rails with horizontal rails coupled therebetween to form a wheel chair with a push handle at the upper extent of the rearward vertical rails and wheels rotatably secured to the lower extent of the frame;

a pair of upper slide rails in a horizontal orientation and spaced parallel with respect to each other and coupled at their forward ends to the forward vertical rail and coupled at their rearward ends to the rearward vertical rail;

a pair of lower slide rails in a horizontal orientation and spaced parallel with respect to each other and coupled at their forward ends to the forward vertical rail and coupled at their rearward ends to the rearward vertical rail;

a pair of upper C-shaped channels formed in the upper slide rails facing each other and laterally spaced by a first predetermined distance;

a pair of lower C-shaped channels formed in the lower slide rails facing each other and laterally spaced by a first predetermined distance;

an upper tray formed in a planar configuration with enlarged horizontal lateral edges received in the upper channels and formed with a central planar surface to constitute a seat for a user;

a lower tray with enlarged horizontal lateral edges received in the lower channels, the central extent of the lower tray being formed with a recess to function as a toilet;

two pair of recesses formed on the exterior surface of each tray facing outwardly at a forward extent thereof and at a rearward extent thereof;

two pair of holes formed in the exterior surface of each slide rail at a forward extent thereof and at a rearward extent thereof; and a pair of pivotable catches secured to the forward and rearward vertical rails adjacent to the slide rails adapted to move to an inoperative position remote from the trays to allow for the sliding movement of the trays with respect to the slide rails and an operative position within the recesses in interference contact with the trays to preclude inadvertent removal of the trays from the slide rails.

* * * * *